US009368241B2

(12) United States Patent
Loewen et al.

(10) Patent No.: US 9,368,241 B2
(45) Date of Patent: Jun. 14, 2016

(54) SYSTEM AND METHOD FOR PROCESSING AND STORING POST-ACCIDENT COOLANT

(75) Inventors: Eric P. Loewen, Wilmington, NC (US); John F. Berger, Wilmington, NC (US); Brett J. Dooies, Wilmington, NC (US)

(73) Assignee: GE-HITACHI NUCLEAR ENERGY AMERICAS LLC, Wilmington, NC (US)

( * ) Notice: Subject to any disclaimer, the term of this patent is extended or adjusted under 35 U.S.C. 154(b) by 756 days.

(21) Appl. No.: 13/537,373

(22) Filed: Jun. 29, 2012

(65) Prior Publication Data

US 2014/0005462 A1 Jan. 2, 2014

(51) Int. Cl.

| | |
|---|---|
| ***G21C 19/42*** | (2006.01) |
| ***G21F 9/12*** | (2006.01) |
| ***G21F 9/20*** | (2006.01) |
| ***G21F 9/34*** | (2006.01) |

(52) U.S. Cl.

CPC .. *G21F 9/12* (2013.01); *G21F 9/20* (2013.01); *G21F 9/34* (2013.01)

(58) Field of Classification Search

CPC ..... G21F 5/00; G21F 5/002; G21F 5/02; G21F 5/06; G21F 9/00; G21F 9/007; G21F 9/04; G21F 9/20; G21F 9/22; G21F 9/12

See application file for complete search history.

(56) References Cited

U.S. PATENT DOCUMENTS

| | | | | |
|---|---|---|---|---|
| 3,338,665 | A | 8/1967 | Silverman | |
| 3,712,851 | A | 1/1973 | Isberg et al. | |
| 3,889,707 | A | 6/1975 | Fay et al. | |
| 3,958,630 | A | 5/1976 | Smith | |
| 3,962,078 | A | 6/1976 | Hirs | |
| 5,295,170 | A | 3/1994 | Schulz | |
| 5,611,929 | A | 3/1997 | Libutti et al. | |
| 8,003,845 | B2 | 8/2011 | Pinet et al. | |
| 2004/0182791 | A1 * | 9/2004 | Kuhn | B01J 20/24 205/46 |
| 2013/0039822 | A1 * | 2/2013 | Hasan | B01J 20/24 423/2 |
| 2013/0140005 | A1 | 6/2013 | Tietsch et al. | |

FOREIGN PATENT DOCUMENTS

| | | |
|---|---|---|
| EP | 0859671 B1 | 8/2010 |
| JP | 5171500 A | 6/1976 |
| JP | S56 51246 A | 5/1981 |
| JP | 5847300 A | 3/1983 |

(Continued)

OTHER PUBLICATIONS

Sher, R. et al. "Transport and Removal of Aerosols in Nuclear Power Plants Following Severe Accidents"; American Nuclear Society, 2011.

(Continued)

*Primary Examiner* — Marshall O'Connor

(74) *Attorney, Agent, or Firm* — Harness, Dickey & Pierce, P.L.C.

(57) ABSTRACT

A method for processing a coolant includes filtering a coolant using a first filtration system to generate a first filtered material, and filtering the filtered coolant using a second filtration system to generate a second filtered material. The second filtration system is different from the first filtration system. The first filtered material is transferred to a first waste treatment container and converted to a first waste product for permanent disposal, and the second waste product is transferred to a second waste treatment container and converted to a second waste product for permanent disposal.

20 Claims, 3 Drawing Sheets

(56) References Cited

FOREIGN PATENT DOCUMENTS

| | | | | |
|---|---|---|---|---|
| JP | 01318997 | A | | 12/1989 |
| JP | 04156909 | A | | 5/1992 |
| JP | 0694896 | A | | 4/1994 |
| JP | 07333393 | A | | 12/1995 |
| JP | 08110395 | A | | 4/1996 |
| JP | H09 54195 | A | | 2/1997 |
| JP | 11242095 | A | | 9/1999 |
| JP | 2000346994 | A | | 12/2000 |
| JP | 2001239138 | A | | 9/2001 |
| JP | 2008500162 | A | | 1/2008 |
| KR | 20050010734 | A | | 1/2005 |
| KR | 20050010734 | | * | 1/2008 |
| WO | 2013031689 | A1 | | 3/2013 |

OTHER PUBLICATIONS

"Alternative Radiological Source Terms for Evaluating Design Basis Accidents at Nuclear Power Reactors"; Regulatory Guide 1.183, pp. 12-15; U.S. Nuclear Regulatory Commision, Office of Nuclear Regulatory Research; Jul. 2000.

"100.11 Determination of exclusion area, low population zone, and population center distance"; Title 10 of CFR 100, section 11; U.S. Nuclear Regulatory Commision; Nov. 2012.

'Spent Fuel Heat Generation in an Independent Spent Fuel Storage Installation'; U.S. Nuclear Regulatory Commission (NRC) Reg. Guide 3.54; Mar. 2011.

EP Search Report issued in connection with corresponding EP Patent Application No. 13173987.2 dated on Sep. 30, 2013.

U.S. Office Action for corresponding U.S. Appl. No. 13/710,766 issued Jul. 13, 2015.

Unofficial English Translation of Japanese Office Action issued in connection with corresponding JP Application No. 2013-133255 on Mar. 3, 2015.

Unofficial English Translation of Mexican Office Action issued in connection with corresponding MX Application No. MX/a/2013/007707 on Apr. 22, 2015.

U.S. Office Action dated Nov. 17, 2015 issued in co-pending U.S. Appl No. 13/710,766.

* cited by examiner

SYSTEM AND METHOD FOR PROCESSING AND STORING POST-ACCIDENT COOLANT

BACKGROUND

1. Field

Some example embodiments relate generally to a chemical separations system and/or method for processing and storing post-accident coolant, and more particularly to a chemical separations system and/or method of filtering post-accident water to remove fission products and salts for permanent disposal.

2. Related Art

After a reactor accident, efforts are typically made to have the reactor core reprocessed and/or placed in interim storage. However, the mitigation of the reactor accident may be complicated by the introduction of foreign materials. For instance, in the Fukushima Daiichi accident in 2011, seawater was used in an attempt to cool the reactors. As a consequence of the use of seawater, sea salts were deposited in the reactors. Accordingly, the integrity of metal containers intended for subsequently storing the recovered fuel from the reactor core may be compromised by the corrosive action of the sea salts.

When the reactor is operating, the radioactive soluble and/or insoluble impurities may be removed, at least in part, by one or more demineralizers, filters, ion exchangers, and/or other devices (collectively referred to in this application as a Reactor Water Cleanup Unit ("RWCU")). For a damaged reactor core injected with off-specification water (e.g., seawater) using the normal RWCU, a relatively large volume of ion-exchange resin may be generated. Therefore, the RWCU filter beds would need to be changed frequently, thereby making the process more difficult and costly. In addition, operation of the RWCU allows for coolant (e.g., water) to be extracted from the bottom of the reactor, which may be obstructed due to damaged components and fuel. Furthermore, the spent resin is not stable enough for permanent waste storage due to relatively large amounts of radioactivity.

SUMMARY

Some example embodiments provide a chemical separations method and/or system for processing and storing a post-accident coolant including contaminants, e.g., corium, sea salts, etc.

An example embodiment of a method for processing a coolant includes filtering a coolant using a first filtration system to generate a first filtered material, and filtering the filtered coolant using a second filtration system to generate a second filtered material. The second filtration system is different from the first filtration system. The first filtered material is transferred to a first waste treatment container to convert the first filtered material to a first waste product for permanent disposal, and the second filtered material is transferred to a second waste treatment container to convert the second filtered material to a second waste product for permanent disposal.

An example embodiment of a system includes a first filtration system configured to filter a coolant and generate a first filtered material, and a second filtration system configured to filter the filtered coolant and generate a second filtered material. The second filtration system is different from the first filtration system. A first waste treatment container is configured to convert the first filtered material to a first waste product for permanent disposal, and a second waste treatment container is configured to convert the second filtered material to a second waste product for permanent disposal.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
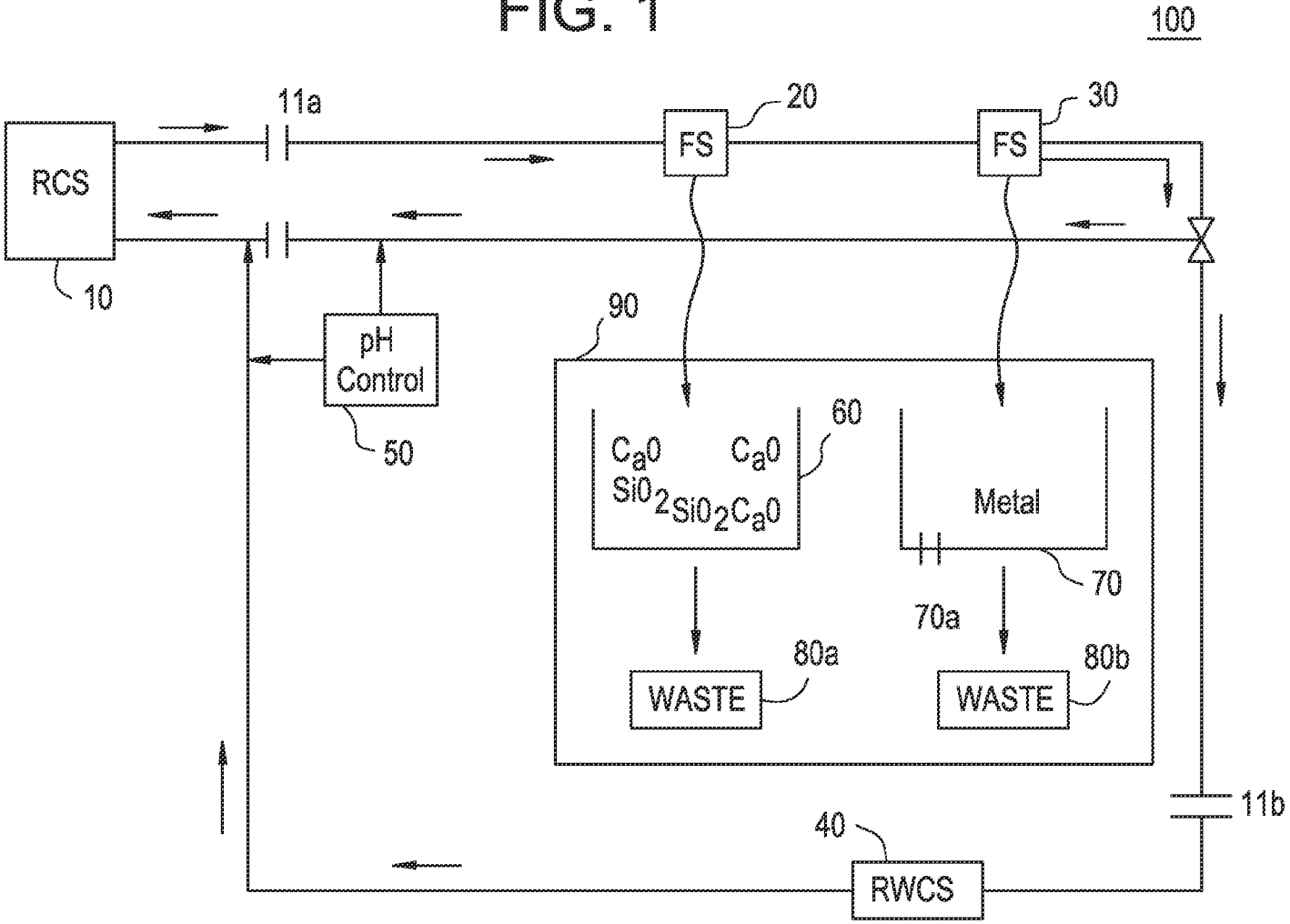
FIG. 1 is a diagram of a system for post-accident coolant processing, in accordance with an example embodiment.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Example embodiments are directed to an in-situ technique to remove relatively large amounts of contaminates from reactor coolant after fuel damage and off-specification coolant injection, for example, sea water. The nuclear material, e.g., corium, is removed from the coolant, and a waste is generated for permanent geologic disposal that is relatively safe, secure and stable.

The nuclear material referred to herein may be corium, although example embodiments are not limited thereto. As understood by those of ordinary skill in the art, corium is a fuel containing material (FCM) that is formed during a nuclear meltdown. In particular, corium is a lava-like molten mixture of portions of a nuclear reactor core and may include nuclear fuel, fission products, control rods, structural materials from the affected parts of the reactor, products of their chemical reaction with air, water, and steam, and/or molten concrete from the floor of the reactor room in situations where the reactor vessel is breached, and resulting from the introduction of foreign materials, such as seawater or boron injections. The composition of corium depends on the type of the reactor and, specifically, on the materials used in the control rods and the coolant. For instance, there are differences between pressurized water reactor (PWR) corium and boiling water reactor (BWR) corium. In addition to corium, it should be understood that the nuclear material referred to herein may include used nuclear fuel or other analogous materials in need of similar treatment.

The method according to an example embodiment decontaminates the coolant, e.g., water, thereby enhancing an ability to decommission the reactor and internals, and mitigates internal corrosion (e.g. stress corrosion cracking, general chloride induced corrosion, or intergranular corrosion) to the container for long-term storage of the waste.

FIG. 1 is a diagram of a system for post-accident processing, in accordance with an example embodiment. The system includes a reactor coolant system (RCS) 10, first and second coolant monitoring systems 11*a* and 11*b*, first and second filtering systems 20 and 30, a reactor water cleanup system 40, a pH control unit 50, first and second waste treatment containers 60 and 70, first and second waste products 80*a* and 80*b*, and a waste treatment area 90. A first coolant monitoring system 11*a*, using measurement devices such as a mass spectrometer, a conductivity meter, and a pH meter, determines the particular parameters, for example, elemental composition, conductivity, pH, temperature, etc., of the coolant, e.g., water, positioned upstream from first and second filtering systems 20 and 30. A second coolant monitoring system 11*b* is positioned downstream from the first and second filtering systems 20 and 30, and performs the same function for the filtered coolant. The flow of coolant may originate from a reactor coolant system (RCS) 10, and the RCS 10 may be any boiling water reactor (BWR) piping circuit. For example, the BWR piping circuit may be one of a reactor water cooling unit (RWCU), residual heat removal (RHR) system, core spray (CS) system, high pressure coolant injection (HPCI) system and/or feedwater.

Figure 2:
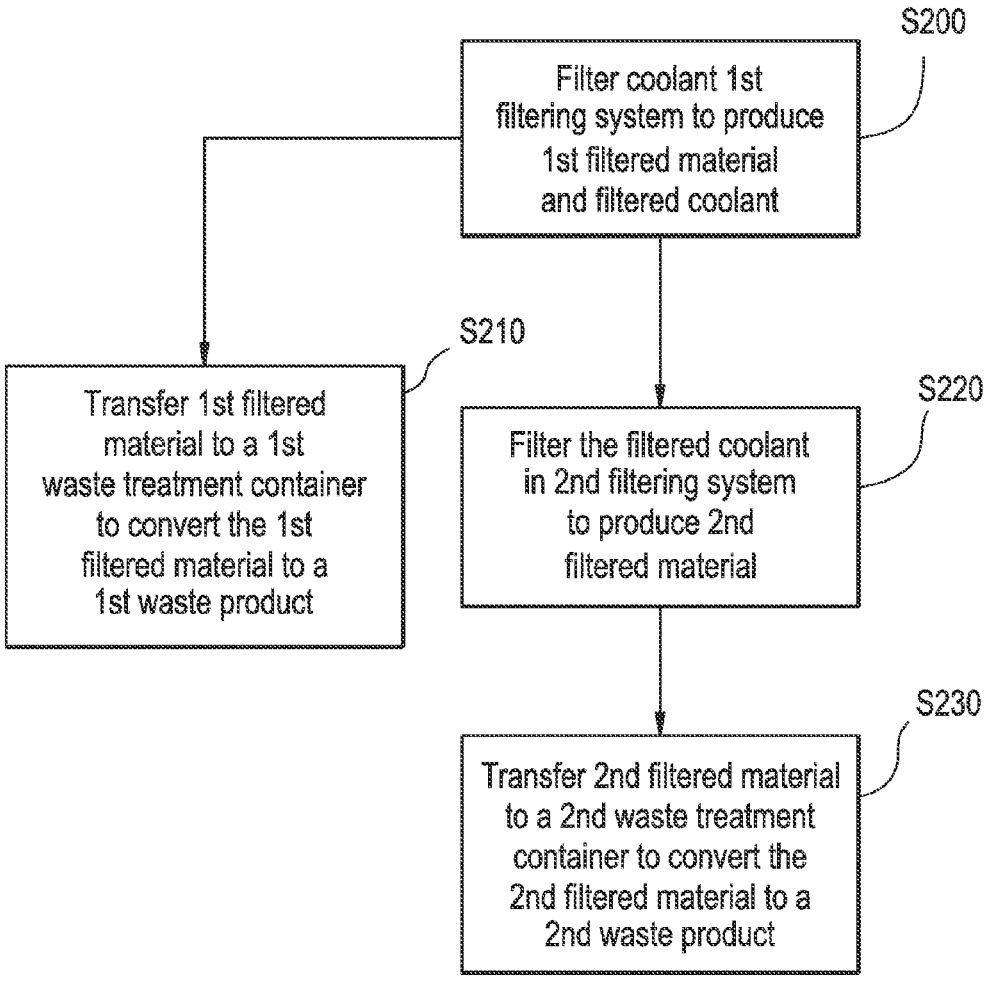
FIG. 2 is a flow diagram of a method for processing a post-accident coolant, in accordance with another example embodiment.

FIG. 2 is a flow diagram of a method for processing a post-accident coolant, in accordance with another example embodiment. In step S200 of FIG. 2, a coolant, e.g., water, is filtered in a first filtering system 20, for example, an activated alumina bed, in order to remove radioactive particulates in the coolant, thereby producing a first filtered material and a filtered coolant including additional contaminants not absorbed by the first filtering system 20. The radioactive particulates, e.g., cesium and iodine, are absorbed into the alumina matrix. The alumina matrix absorbs the radioactive material in the coolant such that the radioactive material may be permanently stored.

The first filtering system 20, e.g., alumina bed, is part of a first Shielded Removable Filter (SRF) system, which shields plant personnel and equipment from accumulated radionuclides during the cleanup process. The first SRF includes the filter material included in the alumina bed, and a shielded container made of concrete or steel and optionally lined with an additional shielding material, e.g., steel, lead, or tungsten. The coolant enters and exits the first SRF through a tortuous flow path to mitigate any potential radiation streaming paths from the first SRF. The entire first SRF (e.g., container and filter material of the alumina bed) is designed to be easily inserted into and removed from the filtration process, and is designed to be easily transported due to its modular nature.

In step S220 of FIG. 2, the filtered coolant flows from the first filtering system 20 to a second filtering system 30, e.g., humate bed, thereby producing a second filtered material including contaminants that remain in the filtered coolant. The second filtering system 30, e.g., humate bed, is part of a second SRF having a similar filtering function as that described with respect to the first SRF. Humates are complex molecules formed by the breakdown of organic matter. Humates contain humic acids, which are colloids that behave similar to clay. Examples of humates include monovalent alkali metals (e.g., sodium humate and potassium humate) that are soluble in water, humates of multivalent metals (e.g., calcium humate, magnesium humate, and iron humate) and heavy metal humates that are insoluble. It is well known in the art that humates can be used for the formation of fertile soil because humates are a source of plant nutrients.

When the cation exchange sites on the humic acid molecule are filled predominately with hydrogen cations, the material is determined to be an acid. The pH is not greatly affected, however, because the acid is insoluble in water. When the predominant cation on the exchange sites is other than hydrogen, the material is determined to be a humate. Apart from the effect on the solubility of materials and their absorption by clays, the different cations may have little effect on the humic molecules. The humic molecules have relatively low water solubility in the neutral to acidic pH range, but may be soluble at higher pH levels, e.g., greater than 10, thereby producing dark brown solutions. Humic acid of the second filtering system 30 can immobilize most of the contaminants in the coolant, e.g., water.

Figure 3:
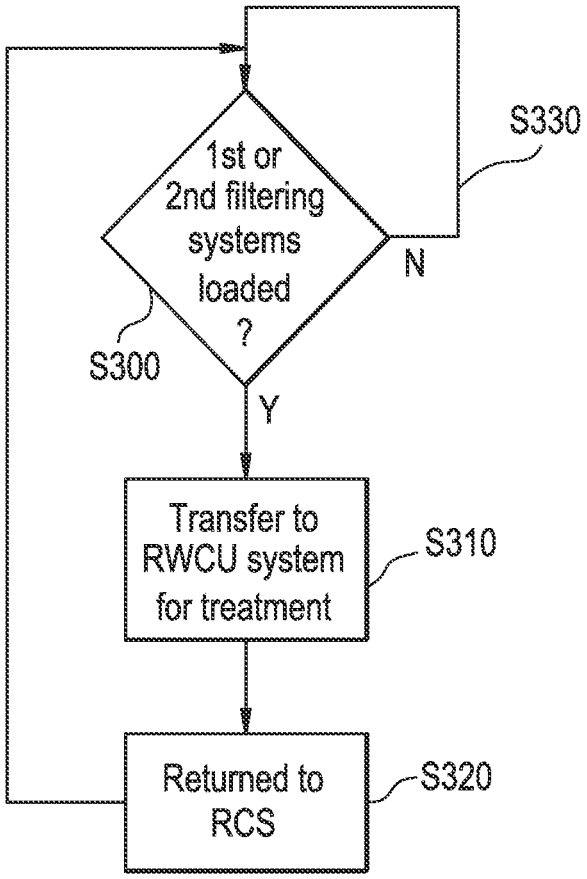
FIG. 3 is a flow diagram of a method for storing a post-accident coolant, in accordance with another example embodiment.

FIG. 3 is a flow diagram of a method for storing a post-accident coolant, in accordance with another example embodiment.

The fluid stream of the coolant will flow through the first and second filtering systems 20 and 30, e.g., the alumina and humate beds, until either the first or second filtering system 20 or 30 reaches its radioactive loading limit (S300). The radioactive loading limit is determined by a threshold radiation dose detected in the SRF including the first and second filtering systems 20 and 30, e.g., the alumina and humate beds, and the point in which the SRF has become chemically exhausted (e.g., filled) is determined by the second coolant monitoring system 11*b* positioned downstream from the second filtering system 30.

In an example embodiment, if neither the first or second filtering system 20 or 30 has reached its loading limit, the method of treating the coolant using the first and second filtering systems 20 and 30 may be repeated a number of times until undesirable levels of the harmful contaminates are removed (S330). If either of the first or second filtering system 20 or 30 have reached the loading limit, the filtered coolant may be transferred to the RWCU system 40 (S310), which may be the conventional plant system for treating the coolant, and returned to the reactor coolant system RCS 10 (S320). Alternatively, the coolant, e.g., water, may be sent directly to the plant's standard RWCU system 40 for the continued removal of solids and cations, and then returned to the reactor coolant system RCS 10. Each of the first and second filtering systems 20 and 30 (e.g., the alumina bed and the humate bed) can contain multiple lines or trains to allow for continuous operations.

A pH control unit 50 may be used to adjust the pH for optimum or improved operation of the second filtering system 30 and for removal of contaminants. During operation of the system, swings in the pH may be used to shock the system to remove contaminates from the reactor coolant system RCS 10 and place them into the SRFs of the respective first and second filtering systems.

After the water chemistry condition inside the reactor coolant system RCS 10 is improved, the corium is captured in at least one of the first and second filtering systems 20 and 30 by the respective Shielded Removable Filters (SRF). The SRF of the first filtering system, e.g., the alumina bed SRF, and the SRF of the second filtering system, e.g., the humate bed SRF, are processed by different treatment methods which will be described in detail as follows.

The SRF of the first filtering system 20 is dewatered by draining the water and then removing the water through a vacuum extraction system. The captured corium debris and fission products in the alumina bed SRF give off heat which accelerates the dewatering vacuum process. Another optional heat source may be added to the process to externally heat the alumina bed SRF, and further accelerate the dewatering process.

In step S210 of FIG. 2, the first filtered material of the first filtering system is transferred to a first waste treatment container. Referring back to FIG. 1, the SRF of the first filtering system 20 including the first filtered material is transferred to a first waste treatment container 60 in a waste treatment area 90, e.g., an inductively heated ceramic crucible or a carbon suscepter. The heat transferred from the first waste treatment container 60, e.g., ceramic crucible, (and the contents within) will allow for the solids in the corium of the coolant to melt.

Oxide compounds, for example, CaO and $SiO_2$, are added to the first waste treatment container 60, e.g., ceramic crucible. A well-known Ca—Al—Si ceramic system, for example, a feldspar mineral such as anorthite, is formed within the first waste treatment container 60, e.g., ceramic crucible, from the reaction between CaO, $SiO_2$, and $Al_2O_3$, and the corium is incorporated into a leach resistant matrix within the first waste treatment container 60, e.g., ceramic crucible, suitable for permanent disposal.

The first waste treatment container 60, e.g., ceramic crucible, containing the additives as described herein is an example embodiment of a system for processing the corium for long-term storage, but other well-known ceramic systems may also be used to contain the corium, e.g., glass-bonded sodalite, synroc, etc., depending on the process and regulatory requirements for the final waste product. This ceramic system within the first waste treatment container 60, e.g., ceramic crucible, is loaded into a waste canister (not shown) and consolidated into a monolithic first waste product 80*a* for long-term storage. The first waste product 80*a* may be evaluated for leachability, structural stability, and other regulatory checks before long-term storage. The first waste product 80*a* contains a majority of the soluble fission products and transuranics found in the coolant.

In step S230 of FIG. 2, the second waste product from the second filtering system is transferred to a second waste treatment container. The second filtering system 30, e.g., the humate bed, requires a different method to produce a more stable waste product for long-term storage in the waste treatment area 90. The humates are first dewatered by the method previously described with respect to the first filtering system, e.g., the alumina bed. However, the second filtering system 30, e.g., humate bed, is loaded into a second waste treatment container 70, e.g., metallic crucible. The second waste treatment container 70, e.g., metallic crucible, has relatively thick walls. The metallic crucible is heated to a temperature above 100° C., and an oxidizing gas, e.g., at least one of air, oxygen and any other oxidizing gas, is injected into the bottom via a tuyere 70*a*. The oxidizing gas converts the humic acids, organic materials, and carbon within the SRF of the second filtering system 30, e.g., the humate bed, to at least one of carbon monoxide and carbon dioxide. The at least one of carbon monoxide and carbon dioxide may be a substantially non-radioactive gas (except for the small amount of Carbon-14 recovered from the reactor coolant), which is then vented from the second waste treatment container 70, e.g., metallic crucible, to a standard nuclear gas filtration system (not shown), e.g., a HEPA system. The venting of the substantially non-radioactive gas to the filtration system mitigates any release of radioactive particulates to the environment. After decarbonizing the second filtering system 30, e.g., humate bed, the ingredients for at least one of a glass-bonded sodalite and synroc composition are added to the metallic crucible and mixed. Then, the composition is placed under a hot-sintering press, and pressed with the hot-sintering press into a second waste product 80*b*. Minor amounts of transuranics and other soluble fission products that pass through the first filtering system 20 and sea salts are captured in this second waste product 80*b*.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A method for processing a coolant comprising:

filtering a coolant using a first filtration system to generate a first filtered material including a first set of contaminants and a separate filtered coolant including a second set of contaminants different from the first set of contaminants;

filtering the filtered coolant using a second filtration system to generate a second filtered material including the second set of contaminants, the second filtration system being different from the first filtration system;

transferring the first filtered material from the first filtration system to a first waste treatment container to convert the first filtered material to a first waste product for permanent disposal; and transferring the second filtered material from the second filtration system to a second waste treatment container to convert the second filtered material to a second waste product for permanent disposal, the second waste product different from the first waste product.

2. The method of claim 1, further comprising:

transferring the coolant to the first filtration system from a reactor coolant system.

3. The method of claim 2, further comprising:

adjusting a pH of the coolant in the reactor coolant system before the transferring the coolant to the first filtration system; and transferring the filtered coolant from the second filtration system to a reactor water cleanup unit (RWCU) for processing.

4. The method of claim 2, further comprising:

monitoring the coolant for particular parameters using a first coolant monitoring system, the first coolant monitoring system positioned upstream from the first filtration system; and monitoring the filtered coolant for the particular parameters using a second coolant monitoring system to determine whether all of the contaminants in the filtered coolant have been removed, the second coolant monitoring system positioned downstream from the second filtration system.

5. The method of claim 4, wherein the filtering the coolant using the first filtration system and the filtering the filtered coolant using the second filtration system is performed multiple times until all of the contaminants have been removed from the filtered coolant.

6. The method of claim 1, wherein the first filtration system includes an alumina bed and the second filtration system includes a humate bed.

7. The method of claim 6, wherein the filtering a coolant further comprises filtering the coolant using a first shielded removable filter (SRF), the first SRF including the first filtered material contained in the alumina bed, the filtering the filtered coolant further comprises filtering the filtered coolant using a second SRF, the second SRF including the second filtered material contained in the humate bed, and the first and second SRFs are each configured to provide radiation shielding to personnel and equipment.

8. The method of claim 7, wherein the first SRF including the alumina bed is transferred to the first waste treatment container, and the transferring the first filtered material further comprises:

transferring the first SRF to a ceramic crucible; and reacting oxide compounds located in the ceramic crucible with the alumina and radioactive particulates to form the first waste product.

9. The method of claim 7, wherein the second SRF including the humate bed is transferred to the second waste treatment container, and the transferring the second filtered material further comprises:

transferring the second SRF to a metallic crucible;

injecting the metallic crucible with an oxidizing gas and heating the metallic crucible to a temperature above 100° C. to convert organic components in the humate bed to a non-radioactive gas;

venting the non-radioactive gas in the metallic crucible to a nuclear gas filtration system; and after the venting, forming a composition including one of a glass-bonded sodalite and synroc, and placing the composition in a hot-sintering press to produce the second waste product.

10. The method of claim 1, wherein the first set of contaminants are radioactive particulates and the second set of contaminants are soluble fission products and sea salts.

11. The method of claim 4, further comprising:

determining a point where the first and second filtration systems are chemically exhausted using the second coolant monitoring system; and transferring the filtered coolant to a reactor water cleanup unit at the point where the first and second filtration systems are chemically exhausted.

12. The method of claim 11, further comprising:

transferring the filtered coolant from the reactor water cleanup unit to the reactor coolant system.

13. The method of claim 1, wherein the transferring the first filtered material further comprises:

transferring the first waste treatment container to a ceramic crucible; and reacting oxide compounds located in the ceramic crucible with the first filtered material to form the first waste product.

14. The method of claim 13, wherein the first waste treatment container includes an alumina bed and radioactive particulates absorbed into the alumina bed.

15. The method of claim 1, wherein the transferring the second filtered material further comprises:

transferring the second waste treatment container to a metallic crucible;

injecting the metallic crucible with an oxidizing gas and heating the metallic crucible to a temperature above 100° C. to convert organic components in the second waste treatment container to a non-radioactive gas;

venting the non-radioactive gas in the metallic crucible to a nuclear gas filtration system; and forming a composition including one of a glass-bonded sodalite and synroc, and placing the composition in a hot-sintering press to produce the second waste product.

16. The method of claim 15, wherein the second waste treatment container includes a humate bed and soluble fission products and sea salts contained in the humate bed.

17. A method for processing a coolant comprising:

filtering a coolant using a first filtration system to generate a first filtered material including radioactive particulates and a separate filtered coolant including soluble particulates, the first filtration system including an alumina bed;

filtering the filtered coolant using a second filtration system to generate a second filtered material including the soluble particulates, the second filtration system including a humate bed;

transferring the first filtration system to a first waste treatment container to convert the first filtered material including the radioactive particulates to a first waste product for permanent disposal; and transferring the second filtration system to a second waste treatment container to convert the second filtered material including the soluble particulates to a second waste product for permanent disposal.

18. The method of claim 17, further comprising:

transferring the coolant to the first filtration system from a reactor coolant system before the filtering a coolant; and transferring the filtered coolant from the second filtration system to a reactor water cleanup unit (RWCU) for processing after the filtering the filtered coolant.

19. The method of claim 4, wherein the filtering the coolant using the first filtration system and the filtering the filtered coolant using the second filtration system is performed multiple times until the first and second filtration systems are determined to be chemically exhausted using a coolant monitoring system.

20. The method of claim 17, wherein the transferring the first filtration system further comprises transferring the first waste treatment container to a ceramic crucible, and reacting oxide compounds located in the ceramic crucible with the first filtered material to form the first waste product; and the transferring the second filtration system further comprises transferring the second waste treatment container to a metallic crucible, injecting the metallic crucible with an oxidizing gas and heating the metallic crucible to convert organic components in the second waste treatment container to a non-radioactive gas, venting the non-radioactive gas in the metallic crucible, adding components of one of a glass-bonded sodalite and synroc to the metallic crucible to form a composition, and placing the composition in a hot-sintering press to produce the second waste product.

* * * * *